United States Patent [19]

Hogg

[11] Patent Number: 4,669,169

[45] Date of Patent: Jun. 2, 1987

[54] METHOD OF MOUNTING AN ARTICLE TO A SUBSTRATE

[75] Inventor: James W. Hogg, Nashville, Tenn.

[73] Assignee: Anchor Wire Corporation of Tennessee, Goodlettesville, Tenn.

[21] Appl. No.: 790,603

[22] Filed: Oct. 23, 1985

Related U.S. Application Data

[63] Continuation of Ser. No. 594,395, Mar. 28, 1984, Pat. No. 4,619,430, which is a continuation-in-part of Ser. No. 393,550, Jun. 30, 1982, Pat. No. 4,485,995, which is a continuation-in-part of Ser. No. 268,499, May 29, 1981, Pat. No. 4,422,608.

[51] Int. Cl.[4] ..... B23P 11/00

[52] U.S. Cl. ..... 29/432; 29/526 R; 411/441; 411/907; 411/908; 428/4

[58] Field of Search ..... 29/432, 432.1, 432.2, 29/526 R; 248/467; 411/441, 907, 908, 544; 206/346, 347; 219/99; 428/4, 12, 23, 24

[56] References Cited

U.S. PATENT DOCUMENTS

| | | | |
|---|---|---|---|
| 427,317 | 5/1890 | Hauger | 248/467 X |
| 2,060,058 | 11/1936 | Engelmeier | 428/4 |
| 2,968,984 | 1/1961 | De Caro | 411/441 |
| 3,176,361 | 4/1965 | Jensen | 428/4 X |
| 3,300,173 | 1/1967 | Kennedy, Jr. | 248/467 |
| 3,490,329 | 1/1970 | Pratorius | 411/441 |
| 3,494,018 | 2/1970 | Helderman et al. | 29/432 |
| 3,841,474 | 10/1974 | Maier | 206/346 |
| 3,955,674 | 5/1976 | Maier et al. | 206/347 |
| 4,014,088 | 3/1977 | Oshier | 428/24 X |
| 4,115,912 | 9/1978 | Beck | 29/432 |
| 4,130,751 | 12/1978 | Gordon | 219/99 X |
| 4,286,496 | 9/1981 | Harris | 411/441 |
| 4,322,193 | 3/1982 | Stahl | 411/544 X |

*Primary Examiner*—Charlie T. Moon
*Attorney, Agent, or Firm*—Fisher, Christen & Sabol

[57] ABSTRACT

A brick and block hanger has a nail and a resilient finned sleeve which is slidably mounted upon the nail to cushion impact and prevent shattering of brick or block when the nail is driven into the brick or block. The nail and resilient finned sleeve are used in combination with a picture hanger or frame hanger, and can be used for attaching other articles to brick or block as well. During penetration of the nail into a substrate such as brick or block, the finned sleeve deforms until a characteristic rosette shape is formed. At this point, cessation of force is indicated.

14 Claims, 13 Drawing Figures

METHOD OF MOUNTING AN ARTICLE TO A SUBSTRATE

BACKGROUND OF THE INVENTION

This is a continuation of U.S. Application Ser. No. 06/594,395 filed on Mar. 28, 1984, now U.S. Pat. No. 4,619,430, entitled "Picture Frame Hanger, which is a continuation-in-part of U.S. Application Ser. No. 393,550, filed on June 30, 1982, now U.S. Pat. No, 4,485,995, which is a continuation-in-part of U.S. Application Ser. No. 268,499, filed May 29, 1981, now U.S. Pat. No. 4,422,608.

1. Field of the Invention

The invention relates to devices for supporting objects from a flexible, elongated article, and in particular, to a picture hanger. The invention also relates to fasteners insertable into brick and block materials.

2. Prior Art

Over the years patents have been issued for various frame picture hangers. Two problems, however, are typical of known picture hangers. First, picture hangers are typically stamped from sheet metal and one end is curved to form a U-shaped hook. The wire fastened to a picture frame is suspended from such hook. Because the edges of the U-shaped hook are sharp, the wire becomes frayed and is damaged with use.

Second, because of the U-shaped portion of the hook, there is a lot of play when the wire is placed in the hook. The wire tends to move in the bight of the U-shaped portion away from the wall causing a lever action on the anchor fastening the picture hanger to the wall. Because the anchor is usually a nail, the lever action loosens the nail causing the hanger to sag sometimes to become loose.

U.S. Pat. No. 1,161,268 (Tuck) attempts to solve these problems by stamping out a narrow tongue from a backplate and rolling it out away from the backplate to form a curved wedge into which a frame wire will be placed. Furthermore, Tuck discloses the use of nails to secure the picture hanger to a wall.

U.S. Pat. No. 4,286,496 to Harris discloses a slidable thin sleeve arrangement for use with a nail driven by a powderactuated device. The tip member of the Harris reference is formed of an elastomeric material, such as vinyl, and the thin portions are flexible.

U.S. Pat. No. 1,652,648 issued to Swangren shows a soft metal washer for nails. In particular, FIG. 6 is of relevance for showing the flexible metal washer being deformed under the head of the nail into an opening between the nail and a surrounding crown of corrugated sheathing indicated as S in FIG. 6.

Pratorius, in U.S. Pat. No. 3,490,329, discloses a bolt assembly for use in an explosive-actuated bolt setter. FIGS. 1, 3, and 4 show various embodiments of the bolt. A plastic jacket 2 made of a tough elastic which is cold flowing surrounds the bolt body. The jack extends substantially the entire length of the bolt save for the penetrating tip end, and during driving of the jacket is deformed to prevent buckling of the bolt.

A thin sleeve is shown in U.S. Pat. No. 3,137,195 to Rosenberg, Jr., in FIG. 3. There are eight inner protrusions and eight outer protrusions on the body of the thin sleeve. The sleeve is made of plastic which is capable of withstanding the force and heat of the explosion without disintegrating and which will remain intact throughout the travel of the stud through the tool. Furthermore, the Rosenberg, Jr. patent discloses that the sleeve may be used with various types of fastening elements such as pins, nails, threaded studs, eyelet nails, and the like which are fired into steel, concrete, masonry and the like materials.

A stud for explosive installation having a thin sleeve is shown in Erickson in U.S. Pat. No. 2,676,508. The sleeve may be constructed of any resilient material including paper, plastic, rubber, or a vinyl resin which is readily combustible or friable so that the ring will be destroyed or substantially destroyed by burning during the expelling of the stud from the tool.

U.S. Pat. No. 3,300,173 issued to Kennedy, Jr. discloses a rigid plastic material jig used to guide a nail into a wall. U.S. Pat. No. 2,968,984 issued to De Caro shows a stud having a tip-enclosing guide with a ribbed flange. U.S. Pat. No. 3,516,323 issued to O'Brien discloses a tip-enclosing guiding element for a fastener. U.S. Pat. No. 3,47,825 issued to Caty is directed to an elastic washer having ribs thereon.

U.S. Pat. Nos. 647,738, 992,203, 2,330,373, 2,334,700, 3,912,211 and 4,286,496, and U.S. Pat. No. Des 42,940 show other hangers.

SUMMARY OF THE INVENTION

An object of the invention is to provide a device, such as a picture hanger, for supporting objects having a flexible, elongated hanging means. Another object of the invention is to provide such a device which eliminates the prior art problems set out above. Another object is to provide a fasterner insertable into brock and block materials. Other objects and advantages of the invention are set out herein.

The objects and advantages of the invention are achieved by the picture hangers and object-supporting device of the present invention.

The invention involves a device for supporting objects having a flexible, elongated hanging means. In accordance with the illustrative embodiment of the invention, a groove and a contact area, having a smooth, curved top surface, is formed by connecting a convex shaped lip with a backplate. An elongated, flexible object, such as a wire supporting a picture frame, when placed over the convex-shaped lip, slides down into the groove, contacts the top surface of the contact area, and is tucked against the backplate. Because the point of connection between the convex lip and the backplate forms a groove and a contact area which is arced, the elongated, flexible object follows the contour of the arced contact area. As a result, the flexible object remains intact and its life is lengthened by not contacting sharp edges or being supported by a surfaced having a printed or sharp area.

The preferred embodiment of the aforementioned invention relates to a device for hanging a picture frame from a wall. An anchor is provided for securing the backplate to the wall.

Where the wall is made of concrete, mortar, or brick, the backplate can be fastened to the wall by driving a nail or a screw through a tight fitting hole provided in the backplate into the wall. A flexible sleeve is disposed about the shaft of the nail in order to act as a shock absorber and to prevent or lessen the chances of shattering the wall. Nails or screws can also be used where the backplate has one or more holes in the top thereof. Three offset holes are employed in one preferred embodiment.

DETAILED DESCRIPTION OF THE INVENTION

Figure 1:
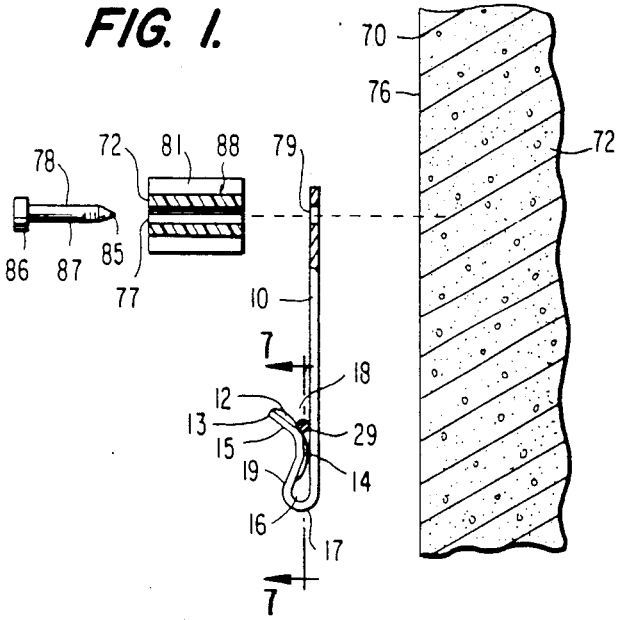
FIG. 1 is an assembly view as seen from the right-hand side of a hanger according to the present invention, with parts shown partially in section.
Figure 2:
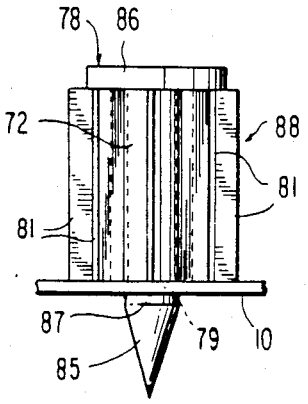
FIG. 2 is a side elevational view of the hanger according to the present invention showing a fastener and a resilient member.
Figure 4:
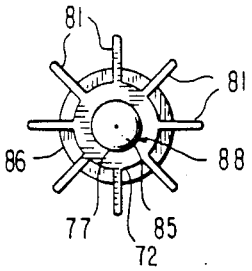
FIG. 4 is a bottom elevational view of a fastener assembled together with the resilient member of FIG. 3.

FIG. 1 shows an embodiment especially adapted for anchoring backplate 10 to a wall 70 which is made of concrete, mortar, brick or other similar extremely hard surface, but which can also be used with hollow or solid walls made, for example, of wood, plaster, wallboard and the like. Nail 78 is a concrete nail or the like and has a head 86, a shaft 87 and a point 85. A resilient, finned sleeve 88 has a center cylindrical body 72, with a passageway 77 therein, and a plurality of fins 81 emanating therefrom. Sleeve 88 can be made of a resilient plastic or any other suitable flexible resilient material. Any other type of finned or shaped resilient sleeve can be used in place of sleeve 88. Sleeve 88 fits tightly over shaft 87 of nail 86 as shown in FIGS. 2 and 4. Only point 85 and a small portion of shaft 87 protrude through hole 79. Shaft 87 tightly fits through hole 79 located in the top center portion of backplate 10 (in other words, shaft 87 should be slightly larger than passage 77). Head 86 of nail 78, when ready for driving into wall 70, fits flush against sleeve 88. To mount backplate 10 to wall 70, nail 78 (located in hole 79 and containing sleeve 88 thereon) is driven or pounded into wall 70. Resilient sleeve 88 acts as a shock absorber for the impact of driven nail 78 in wall 70 and prevents the shattering of wall 70 as nail 78 is driven into it. As nail 78 is driven into wall 70, sleeve 88 mushrooms out and forms a characteristic shape, but limits the depth of penetration of nail 78 into wall 70 thereby helping to prevent the wall from shattering and the nail and local area of the wall from separating from the wall properly.

If desired, more than one hole 79 can be used in backplate 10 to accommodate more than one nail 78.

Although diverse means for anchoring the picture hanger to the surface of a wall have been shown it is obvious to anchor the picture hanger to any surface. Further, although the use of the invention has been disclosed with reference to a picture hanger, it is equally useful for suspending any other object by a flexible, elongated article or other hanging means.

FIG. 2 shows a side elevational view of the assembled plate 10, resilient member 88, and nail 78.

Figure 3:
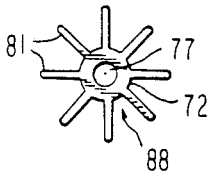
FIG. 3 is a top elevational view of the resilient member.

FIG. 3 is a top elevational view of a resilient member according to the present invention. The resilient member 88 has a generally cylindrical body 72, fins 81, and an interior opening 77. The shaft 87 of the fastner 78 shown in FIGS. 1 and 2, is sized so as to pass snugly within the interior passage 77. Thus, the flexible, resilient member 88 shown in FIG. 3 also serves to guide the fastener 78 as the fastener 78 is driven to penetrate a wall.

As seen in FIG. 4, the fastener 88 fits snugly within the opening 77 of the resilient member 88. FIG. 4 shows a bottom elevational view of the assembly of the fastener 78 and the resilient member 88. The resilient member 88 in this combination serves not only to guide the fastener 78 but also to cushion the shock transmitted to a brick or block surface into which the fastener 78 is to be driven. Thus, in the method of use of the present invention, the assembly shown in FIG. 4 is useful to prevent or greatly reduce damage to a brick or block structure into which the fastener 78 is forcibly inserted. The fastener 78 is forcibly inserted, as by blows from a hammer, or the like, until the resilient member 88 is deformed into a "rosette" during penetration of the nail 78 into substrate 72. Further force applied to the fastener 78 would cause breakage of the resilient member 88, and therefor once a rosette has been formed no further force is applied to the fastener 78. Thus, the appearance of the characteristic rosette shape of the resilient member 88 signals an artisan to stop applying force to the head 86 of the fastener 78. The force, normally applied by the means of hammer blows, can thus be regulated by the present inventive method of use of the resilient member 88 in combination with the fastener 78.

Figure 5:
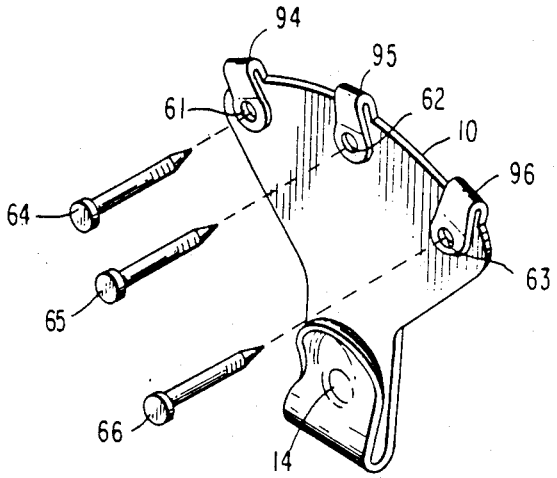
FIG. 5 is perspective view of an embodiment of a hanger usable with the fasteners in the present invention.

Backplate 10, bright 16 and lip 12 can be fabricated from a single piece of sheet metal by stamping out the desired shape, shown in FIG. 5, and shaping bight 16 and lip 12 by bending one end of the stamped sheet metal. Furthermore, lip 12 and backplate 10 can be connected by welding the metal at contact area 14. Alternatively, the picture hanger can be formed by pouring a metal or injecting a non-metal material, such as plastic, into a die or mold.

If wall 30 is curved, backplate 10 can be formed to have the same curve.

To increase the stability and load-carrying capacity of hanger 90, the rear surface of backplate 10 can also be provided with an adhesive provided with a protective removable layer (not shown).

When a picture frame (not shown) fitted with wire 29 is hung from wall 30, wire 29 is slid into groove 18 so as to contact and rest against the curved upper surface of contact area 14. A section of wire 29 is shown in place. The weight of the picture frame pulls wire 29 snugly into groove 18 in contact with contact area 14 and backplate 10. The ends of wire 29 on either side of groove 18 hang substantially downwards and outwards along the face of backplate 10.

Figure 6:
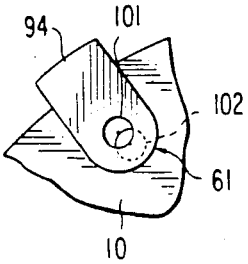
FIG. 6 front elevational view, partially broken away, of the device of FIG. 5.

FIGS. 5 and 6 show an embodiment used when wall 30 is shown to be made from a hard substance, such as brick, block, press boards (wood) and some panellings which do not permit ready or easy manual penetration of the rod 20 of FIGS. 2 and 4.

Figure 8:
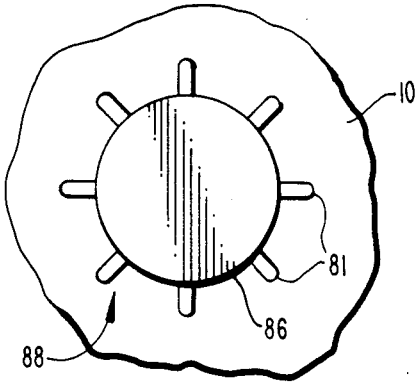
FIG. 8 is a top elevational view of the assembly shown in FIG. 2.

The embodiment can also be used with hollow wall panelling and dry wall, plaster lath walls and the like. It becomes necessary to select backplate 10 having one or more holes 61, 62, 63. Holes 61, 62, and 63 extend through both bent over lips 94, 95 and 96, respectively, and backplate 10. The selection of the correct number of holes 61, 62, . . . , 63 is usually a matter of design choice, except in the case when three such holes are used as shown in FIG. 5. Upon being driven into wall 30, out nails 64 and 66 slant inward toward center nail 65 and downward. This provides better hold and support for the backplate than when only two nails are used or some other configurations of nail holes are used. A toe-in lock of backplate to the wall is provided by the two outer nails that are positioned below and off center from the middle nail in the backplate. In the embodiment shown, hole 62 is located in the center line of backplate 10. The crucial toe-in (and toe-down) feature is achieved by providing holes in backplate 10 which correspond with holes in bent-over lips 94 and 96 in a particular manner. The center hole in backplate 10, which corresponds with the hole in bent-over lip 95, has no toe-in. The means by which the toe-in is achieved with nails 64 and 65 is illustrated in FIG. 8, wherein the left side is s hown. Hole 102 is punched in backplate 10 and has a diameter which is larger than that of nail 64. Hole 101 is punched in lip 94, before it is bent over, in an off-center manner. Hole 101 has a diameter which is substantially the same as the diameter of the shaft of nail 64. When lip 94 is bent over, as shown in FIG. 6, hole 101 is positioned so as to be off-center of hole 102. Hole 101 is far enough off-center of hole 102 as to cover the bottom and right portions of hole 102, as viewed facing backplate 10. When the tip of nail 64 is inserted into holes 101 and 102, and then driven or hit with a hammer or similar device, nail 64 is driven into the wall in a manner which toes-in toward the vertical center line of backplate 10 (and toes-downward). It is imperative that nails 64, 65 . . . 66, screws, or like device selected to anchor backplate 10 to wall 30 fit exactly and tightly within the corresponding holes in lips 94, 95 . . . 96. This helps provide the necessary toe-in or twist prevention. The toeing in (and toeing-down) feature provide much better support and load capability for the hanger. A finned sleeve 88 can be used with each nail 64, 65, 66, in FIG. 5. This embodiment also allows the use of thinner nails, if desired, which provides an advantage over the prior art. Whereas backplate 10 has been shown to be pear-shaped in FIG. 5, any other aesthetic shape could equally have been used. Likewise, although backplate 10 has been shown to be flat in the preferred embodiment, any other surface arrangement could equally have been used.

It is noted that the off-set holes 101, 102 shown in FIG. 6 causes toeing-in of the outermost nail 64 toward the central portion of the plate 10. Similarly, the holes formed in the bent-over portion 63 would be toed-in in a direction generally toward the central region of the plate 10, so that the two outer most nails 64 and 66 are angled towards one another so as to more securely anchor the plate 10 to a structure such as a brick or block.

Figure 7:
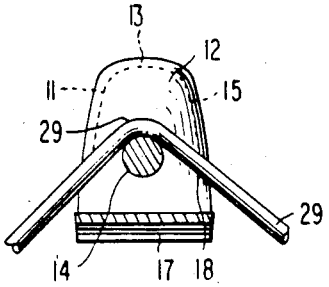
FIG. 7 is sectional view taken along lines 7—7 of FIG. 1.

As seen in FIG. 7, a wire 29 supporting a frame or mirror, or the like, rests against the welded region 14 which connects the back plate 10 to the lip 12.

FIG. 8 is top elevational view of the hanger according to the present invention, including the fastener head 86 overlying the resilient member 88, with the fins 81 projecting outwardly beyond the fastener head 86. The fastener is positioned over a plate 10, which plate 10 may serve as a hanger element for supporting a cord such as shown in FIG. 7.

Figure 9:
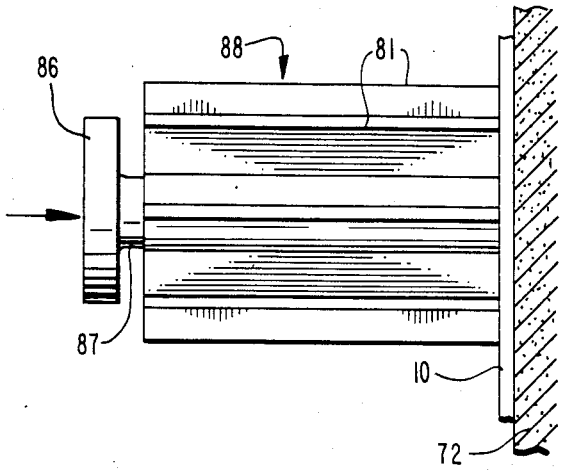
FIG. 9 is a side elevational view of the assembled hanger just as force has begun to be applied to drive the fastener into a wall.

FIG. 9 is side elevational view of the assembly of FIG. 8, also showing the brick or block substrate 72 upon which the hanger element 10 is to be supported. The hanger element 10 is broken away at either end in both of FIGS. 8 and 9, since further details of this structure are unnecessary to an understanding of the method of the present invention.

The arrow in FIG. 9 indicates the direction in which force is to be applied. In FIG. 9, the resilient member 88 serves to provide a guide for the fastener 78. In FIG. 9, no penetration of the wall 72 by the fastener 78 has taken place.

Figure 10:
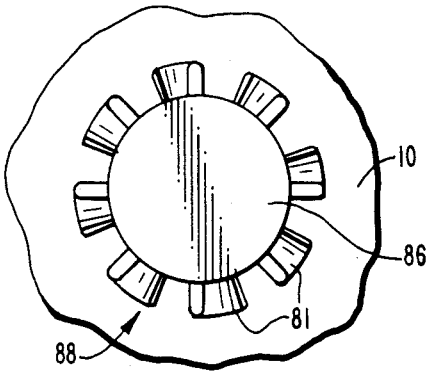
FIG. 10 is a top elevational view of the assembly with the resilient member partially deformed as the fastener has penetrated a portion of a wall.

FIG. 10 is a top elevational view of an intermediate position of the fastener 78. Here, the head 86 is visible over the slightly deformed ribs 81.

Figure 11:
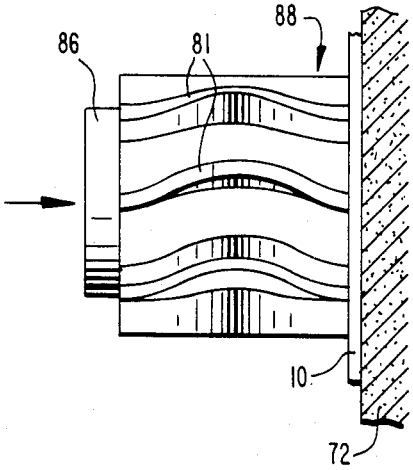
FIG. 11 is a side elevational view of the assembled fastener shown in FIG. 10, showing the condition of the resilient member as the fastener has partly penetrated a wall.

FIG. 11 is a side elevational view of the assembly in the condition shown in FIG. 10. Here, the deformation of the ribs 81 is clearly visible, and the fastener member has penetrated to an intermediate position into the wall 72. The wall 72 has not cracked or been broken, due partially at this stage to the resilient member 88.

Figure 12:
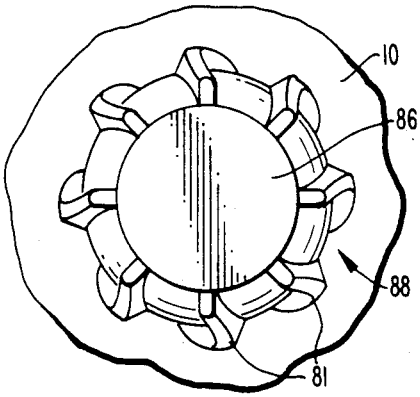
FIG. 12 is a top elevational view of the fastener and deformed resilient member in their final condition.

FIG. 12 is a top elevational view showing the "rosette" formed in the final condition of the resilient member 88, in a final position of insertion of the fastener member 78 into substrate 72.

Figure 13:
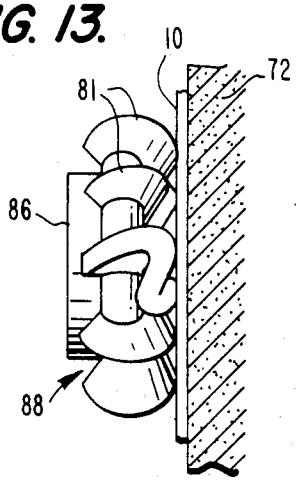
FIG. 13 is a side elevational view of the assembled fastener as it has reached its final position of penetration in a wall.

FIG. 13 is side elevational view of the resilient member 88 in its final condition. In this condition, the artisan stops applying force. Force ordinarily would be transmitted by repeated hammer blows. In this condition, the brick or block substrate 72 is still not cracked or broken, due to the resilient cushioning of the hammer blows by the resilient member 88. The appearance of the rosette shape signals the operator to stop applying force, which also prevents fracturing, crumbling, or breakage of the surface of the brick or block substrate 72.

While a particular resilient member 88 is used in the preferred embodiment, other resiliently deformable members can also be used provided they are capable of receiving a shaft of a fastener which is to be driven into a substrate, and provided the resiliently deformable member is capable of absorbing shock and of deforming into a characteristic shape which is easily recognizable by an artisan so that the artisan can stop applying force to the fastener, thereby preventing breakage of a brick or block substrate.

While a brick or block substrate is the substrate with which the present invention is used, and wherein breakage of such substrate is prevented, the method of use of the present invention is not limited to brick or block substrates, but rather can be used with any substrate including wood, earth, or any other substrates into which fasteners such as nails are known to be used.

The improved method of inserting a fastener, and mounting a hanger to a brick or block substrate, is capable of achieving the above-described advantages, and while preferred embodiments of the present invention have been disclosed, it will be understood that it is not limited thereto but may be otherwise embodied within the scope of the following claims.

What is claimed is:

1. A method of mounting an article to a substrate, comprising:

inserting an elongated headed fastener member into a resiliently deformable externally longitudinally finned article so as to form a fastener assembly;

placing said fastener assembly adjacent a substrate;

applying force by hammer blows to said fastener so as to deform said resiliently deformable article as said fastener penetrates into said substrate;

applying said force until a characteristic rosette shape is formed and apparent from said resiliently deformable article;

whereby said substrate is cushioned by said resiliently deformable article from the force applied to said fastener; and whereby said characteristic shape indicates a final position of said fastener.

2. A method as claimed in claim 1, wherein said resiliently deformable article is composed of plastic.

3. A method is claimed in claim 1, wherein said finned member has a passage adapted to receive a shaft of said fastener; and said finned member has a plurality of fins extending outwardly therefore.

4. A method of fastening an object to a substrate, comprising the steps of:

providing a flexible, resilient externally longitudinally finned member having a passageway formed therethrough;

providing a headed fastener having a shaft, said shaft being adapted to penetrate a substrate;

inserting said shaft of said head fastener into said passageway in said flexible, resilient article to form a fastener assembly;

placing said assembled fastener adjacent said substrate;

applying force by hammer blows to said headed fastener to penetrate said surface with said shaft until said resiliently deformably article is deformed to an apparent rosette;

whereby said flexible, resilient article absorbs shock resulting from said force.

5. A method as claimed in claim 4, wherein said flexible, resilient member is provided with a generally cylindrical body; and wherein said generally cylindrical body is provided with a plurality of fins.

6. A method as claimed in claim 5, wherein said generally cylindrical body has a bore formed therethrough forming said passageway.

7. A method as claimed in claim 4, wherein said headed fastener is provided with an elongated shaft, one end of said elongated shaft being provided with a pointed tip adapted to penetrate a substrate, and another end of said elongated shaft being provided with an enlarged head region adapted to receive blows from a hammer.

8. A method as claimed in claim 1, wherein said substrate is brick.

9. A method as claimed in claim 1, wherein said substrate is a formed block.

10. A method as claimed in claim 4, wherein said substrate is brick.

11. A method as claimed in claim 4 wherein said substrate is a formed block.

12. A method as claimed in claim 1 wherein said substrate is not damaged during penetration of said fastener.

13. The method as claimed in claim 4 wherein said substrate is not damaged during penetration of said fastener into said substrate.

14. A method of mounting an article to a substrate, comprising:

(a) inserting a nail having a head, a shank and a point through a resilient externally longitudinally finned sleeve having a center cylindrical body with a passage extending therethrough, wherein said head is flush with said sleeve and said point protrudes from said sleeve, whereby a fastener assembly is provided; and (b) placing said fastener assembly adjacent a substrate; and (c) applying force to said nail head of said fastener assembly with hammer blows so as to penetrate said surface and deform said sleeve, said applying to continue until a characteristic rosette shape is formed, whereby said substrate is cushioned by said sleeve, and whereby said rosette indicates a final position of said fastener.

* * * * *